US009870877B2

(12) United States Patent
Wu et al.

(10) Patent No.: US 9,870,877 B2
(45) Date of Patent: Jan. 16, 2018

(54) SWITCH SEAT BODY STRUCTURE AND MANUFACTURING METHOD THEREOF

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chih-Hao Sung, New Taipei (TW); Chen-Yun Hsieh, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 82 days.

(21) Appl. No.: 14/600,293

(22) Filed: Jan. 20, 2015

(65) Prior Publication Data

US 2015/0213970 A1 Jul. 30, 2015

(30) Foreign Application Priority Data

Jan. 29, 2014 (TW) ..... 103103639 A
Mar. 7, 2014 (TW) ..... 103108052 A

(51) Int. Cl.

| | |
|---|---|
| ***H01H 1/64*** | (2006.01) |
| ***H01H 9/02*** | (2006.01) |
| ***H01H 11/00*** | (2006.01) |
| ***H01H 13/04*** | (2006.01) |
| ***H01H 13/50*** | (2006.01) |

(52) U.S. Cl.

CPC ..... *H01H 9/02* (2013.01); *H01H 11/00* (2013.01); *H01H 13/04* (2013.01); *H01H 13/50* (2013.01); *H01H 2223/008* (2013.01); *H01H 2239/038* (2013.01); *Y10T 29/49105* (2015.01)

(58) Field of Classification Search

CPC ..... H01H 9/02; H01H 13/50; H01H 13/04; H01H 11/00; H01H 2239/038; H01H 2223/008; Y10T 29/49105

USPC ..... 200/293

See application file for complete search history.

(56) References Cited

U.S. PATENT DOCUMENTS

| | | | | |
|---|---|---|---|---|
| 4,087,666 A * | 5/1978 | DeHaitre | ..... | H01R 12/526 200/507 |
| 4,250,368 A * | 2/1981 | Johnston | ..... | H01H 13/14 200/296 |
| 2013/0032457 A1* | 2/2013 | Quinn | ..... | H01H 13/32 200/341 |

* cited by examiner

*Primary Examiner* — Renee S Luebke
*Assistant Examiner* — Lheiren Mae A Caroc
(74) *Attorney, Agent, or Firm* — Rosenberg, Klein & Lee

(57) ABSTRACT

A switch seat body structure and a manufacturing method thereof. The switch seat body structure is simplified and can be easily manufactured to enhance the resistance of the switch seat body against the external damaging force. The switch seat body structure includes a main body for assembling with an internal component of the switch. The main body is an assembly of a metal head section and a nonmetal belly section. The metal head section has a shoulder section, a skirt section connected with the shoulder section and a subsidiary shoulder section formed on the skirt section. The nonmetal belly section is overlaid and connected on at least a part of the skirt section or the entire skirt section, whereby the nonmetal belly section is connected with subsidiary shoulder section to form an integrated structure.

17 Claims, 2 Drawing Sheets

SWITCH SEAT BODY STRUCTURE AND MANUFACTURING METHOD THEREOF

BACKGROUND OF THE INVENTION

1. Field of the Invention

The present invention relates generally to a switch seat body structure and a manufacturing method thereof, and more particularly to a switch seat body structure including a metal head section and a nonmetal belly section. The nonmetal belly section is overlaid on and integrally connected with the metal head section to form the switch seat body structure.

2. Description of the Related Art

A conventional switch or switch indication device is applied to electrical mechanism, electronic apparatus and auto-control system for an operator to know the operation or power on/off state of the machine. The conventional switch device includes a seat body or main body, an internal component and multiple sets of terminal pins arranged in a chamber defined by the seat body. The terminal pins extend out of the chamber or the seat body for electrically connecting with electrical wires or plugging on the circuit board. A light source is disposed in the chamber of the seat body to electrically connect with a set of positive and negative electrode pins of the terminal pins. A slightly transparent maintenance switch or pushbutton is mounted in an upper section of the chamber of the seat body. By means of the maintenance switch or pushbutton, the light source is controlled to emit light or not to emit light for the operator to know the operation or power on/off state of the machine.

With respect to the manufacturing process and structural design of the switch device, the conventional switch seat body or main body is a cylindrical body entirely made of metal material and having an internal chamber. The outer surface of the seat body is partially milled and processed to form a thread. After the internal component of the switch is assembled in the internal chamber of the seat body, the seat body is pressurize and deformed so as to securely connect the internal component with the seat body to form the switch device.

As well known by those who are skilled in this field, the manufacturing, assembling and processing procedures of the conventional switch seat body are relatively troublesome and time-consuming. As a result, the manufacturing cost for the conventional switch seat body is increased.

In addition, with respect to the structural design, operation and application of the switch device, the conventional switch seat body is made of metal material because of that when an operator operates the seat body of the switch device mounted on the panel or the substrate, the seat body must have a sufficient structural hardness to resist against the damaging force applied to the outer surface of the seat body due to the operation, for example, the reaction force applied to the seat body by the substrate so as to avoid wear of the surface structure of the seat body and prevent the seat body from loosening from the substrate. The wear and loosening of the seat body are not what we expect.

The conventional seat body or main body of the switch device and the relevant, components of the switch device have the above shortcomings in use and structural design. It is therefore tried by the applicant to provide a switch seat body structure, which is redesigned in use form and structure. The switch seat body structure is distinguishable from the conventional technique and the application range of the switch seat body structure is enlarged.

For example, in manufacturing of the conventional switch seat body or main body, the seat body is entirely made of metal material. The outer surface of the seat body is partially milled and processed to form the thread. After the internal component of the switch is assembled in the internal chamber of the seat body, the seat body is pressurize and deformed so as to securely connect the internal component with the seat body. The manufacturing and processing procedure of the conventional switch seat body is troublesome, time-consuming and material-wasting. As a result, the cost for the conventional switch seat body is higher. In contrast, the switch seat body structure of the present invention is free from any of the above problems existing in the conventional switch seat body. In addition, the conventional switch seat body or main body is made of metal material to have a sufficient structural hardness or strength to resist against the damaging force or action force applied to the outer surface of the seat body so as to avoid wear of the surface structure of the seat body and prevent the seat body from loosening from the substrate. Also, the switch seat body structure of the present invention is free from the above problem existing in the conventional switch seat body.

SUMMARY OF THE INVENTION

It is therefore a primary object of the present invention to provide a switch seat body structure and a manufacturing method thereof. The switch seat body structure is simplified and can be easily manufactured to enhance the resistance of the switch seat body against the external damaging force. The switch seat body structure includes a main body for assembling with an internal component of the switch. The main body is an assembly of a metal head section and a nonmetal belly section. The metal head section has a shoulder section, a skirt section connected with the shoulder section and a subsidiary shoulder section formed on the skirt section. The nonmetal belly section is overlaid and connected on at least a part of the skirt section or the entire skirt section, whereby the nonmetal belly section is connected with subsidiary shoulder section to form an integrated structure. The manufacturing and processing procedure of the conventional switch seat body is troublesome and time-consuming. As a result, the cost for the conventional switch seat body is higher. The switch seat body structure of the present invention overcomes the problems existing in the conventional switch seat body.

In the above switch seat body structure, the skirt section of the metal head section is formed with a recessed section. The subsidiary shoulder section protrudes from the recessed section. The nonmetal belly section is overlaid or connected on the recessed section and the subsidiary shoulder section, whereby the nonmetal belly section is connected with the metal head section to form an integrated structure.

The manufacturing method of the switch seat body structure includes steps of:

(a) providing and positioning a metal head section on a female mold of a molding module, the male mold and female mold of the molding module defining therebetween a region in the form of a nonmetal belly section; and (b) filling a nonmetal material or the like into the region defined between the male mold and female mold to form the nonmetal belly section, the nonmetal belly section being connected on at least a part of the metal head section or the entire metal head section, whereby the nonmetal belly section is connected with the metal head section to form an integrated structure.

The present invention can be best understood through the following description and accompanying drawings, wherein:

DETAILED DESCRIPTION OF THE PREFERRED EMBODIMENTS

Figure 1:
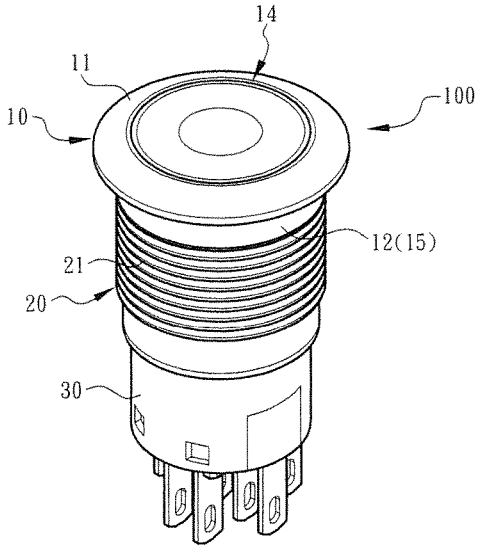
FIG. 1 is a perspective assembled view of the switch seat body structure of the present invention, showing that the internal component of the switch is assembled in the main body.
Figure 2:
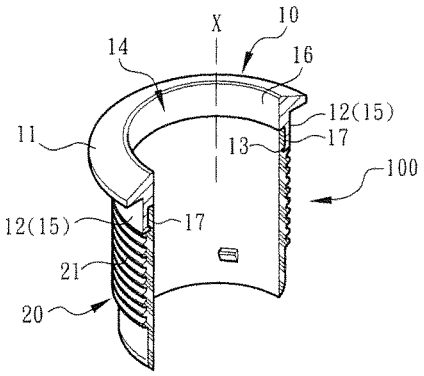
FIG. 2 is a perspective sectional view of the switch seat body structure of the present invention, showing that the metal head section of the main body is connected with the nonmetal belly section.
Figure 3:
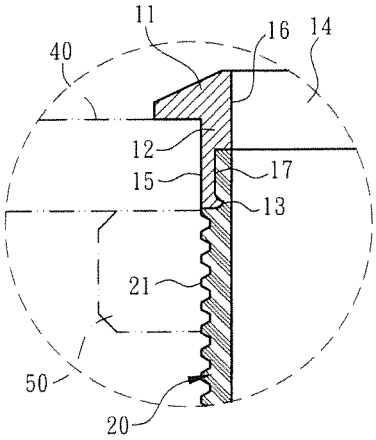
FIG. 3 is a plane sectional view of the switch seat body structure of the present invention, showing that the metal head section of the main body is connected with the nonmetal belly section, in which the phantom lines show that the main body is mounted on a substrate by a nut.

Please refer to FIGS. 1, 2 and 3. The switch seat body structure of the present invention includes a switch seat main body 100. The main body 100 is assembled with an internal component 30 of the switch to forma switch device or switch assembly. In this embodiment, the main body 100 is an assembly of a metal head section 10 and a nonmetal belly section 20. The metal head section 10 has a shoulder section 11, a skirt section 12 connected with the shoulder section 11 and a subsidiary shoulder section 13 formed on the skirt section 12. The shoulder section 11 and the skirt section 12 together define a shaft hole 14 and an axis $\chi$. The shoulder section 11 outward protrudes from the metal head section 10. The skirt section 12 is substantially normal to the shoulder section 11 and downward extends from the shoulder section 11 in the direction of the axis $\chi$ (along the nonmetal belly section 20). The subsidiary shoulder section 13 is formed at a free end of the skirt section 12 and protrudes toward the axis $\chi$. The metal head section 10 is defined with an outer surface 15 and an inner surface 16.

As shown in FIGS. 2 and 3, the skirt section 12 is formed with a recessed section 17 on the inner surface 16. The subsidiary shoulder section 13 protrudes from the recessed section 17.

In this embodiment, the nonmetal belly section 20 is a cylindrical body made of plastic material or the like. The surface of the nonmetal belly section 20 is formed with a thread 21. The nonmetal belly section 20 defines an internal space. In cooperation with the shaft hole 14 of the metal head section 10, the internal component 30 of the switch is assembled in the internal space of the nonmetal belly section 20. The nonmetal belly section 20 is overlaid on at least a part of the inner surface 16 of the skirt section 12 or overlaid on the entire inner surface 16 of the skirt section 12. The drawings show that the nonmetal belly section 20 is overlaid on or connected on the recessed section 17 and the subsidiary shoulder section 13 of the inner surface 16. In addition, the subsidiary shoulder section 13 and the recessed section 17 together provide a latching effect, whereby the nonmetal belly section 20 is integrally latched with the metal head section 10.

Please refer to FIG. 3. When a nut 50 is screwed on the thread 21 of the nonmetal belly section 20 to mount the main body 100 on a substrate 40, the outer surface 15 of the metal head section 10 and the skirt section 12 in adjacency to the shoulder section 11 is at least partially exposed to outer side of the main body 100 to contact and assemble with the substrate 40. Moreover, the metal head section 10 (or the skirt section 12) has such a structural hardness as to resist against the operational action force applied to the switch device by an operator (or the reaction force applied to the main body 100 by the substrate 40) and the wearing force applied to the outer surface of the main body 100 by the substrate 40.

Figure 4:
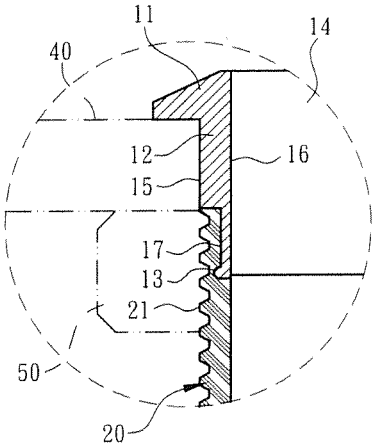
FIG. 4 is a plane sectional view of another embodiment of the switch seat body structure of the present invention, showing that the metal head section of the main body is connected with the nonmetal belly section, in which the phantom lines show that the main body is mounted on a substrate by a nut.

Please refer to FIG. 4. In a modified embodiment of the present invention, the recessed section 17 of the skirt section 12 is formed on the outer surface 15 of the main body 100 and the subsidiary shoulder section 13 protrudes away from the axis $\chi$. Accordingly, the subsidiary shoulder section 13 also protrudes from the recessed section 17. FIG. 4 also shows that the nonmetal belly section 20 is connected on or overlaid on the recessed section 17 and the subsidiary shoulder section 13 of the outer surface 15. In addition, the subsidiary shoulder section 13 and the recessed section 17 together provide a latching effect, whereby the nonmetal belly section 20 is integrally latched with the metal head section 10. When a nut 50 is screwed on the thread 21 of the nonmetal belly section 20 to mount the main body 100 on a substrate 40, the outer surface 15 of the metal head section 10 (or the skirt section 12) contacts and assembles with the substrate 40.

The manufacturing method of the switch seat body structure (or the main body 100) of the present invention includes steps of:

(a) providing and positioning a metal head section 10 on a female mold of a molding module, the male mold and female mold of the molding module defining therebetween a region in the form of the nonmetal belly section 20, the metal head section 10 having a shoulder section 11, a skirt section 12 connected with the shoulder section 11, a recessed section 17 formed on the skirt section 12 and a subsidiary shoulder section 13 formed on the skirt section 12; and (b) filling a nonmetal material (such as plastic material or the like) into the region defined between the male mold and female mold to form the nonmetal belly section 20 with a thread 21 on the surface, the nonmetal belly section being connected on at least a part of the metal head section 10 or connected on the entire metal head section 10, whereby the nonmetal belly section 20 is integrally connected with the metal head section 10.

It should be noted that a part of the outer surface 15 or inner surface 16 of the skirt section 12, (such as the recessed section 17) can be formed with a rough surface structure such as recessed/raised structure, annular stripes, threads or fine pits to help in connecting (overlaying) the nonmetal belly section 20 on the metal head section 10.

In comparison with the conventional technique, the switch seat body structure of the present invention is simplified and more easily operable. The switch seat body structure and the manufacturing method thereof have the following advantages:

1. The main body 100 and the relevant components thereof are redesigned in use and operation form and distinguishable from the conventional technique. For example, the main body 100 is a complex structure composed of a metal head section 10 and a nonmetal belly section 20. The skirt section 12 of the metal head section 10 is formed with a recessed section 17 and a subsidiary shoulder section 13 for latching with the nonmetal belly section 20. The nonmetal belly section 20 is overlaid on a part of the inner surface 16 of the skirt section 12 of the metal head section 10 or overlaid on a part of the outer surface 15 of the skirt section 12. This facilitates the manufacturing and processing procedure of the switch seat body structure. In contrast, the conventional switch seat body is entirely made of metal material. The outer surface of the seat body is partially milled and processed to form the thread. After the internal component of the switch is assembled in the internal chamber of the seat body, the seat body is pressurize and deformed so as to securely connect the internal component with the seat body. The manufacturing and processing procedure of the conventional switch seat body is troublesome, time-consuming and material-wasting. As a result, the cost for the conventional switch seat body is higher. The present invention overcomes the above problems existing in the conventional technique.

2. The nonmetal belly section 20 is connected on at least a part of the metal head section 10 or connected on the entire metal head section 10 (or the recessed section 17 and the subsidiary shoulder section 13 of the skirt section 12). Accordingly, at least a part of the outer surface 15 of the metal head section 10 of the main body 100 is free from the nonmetal belly section 20 and exposed to outer side of the main body 100 to contact and assemble with the substrate. The metal head section 10 has a sufficient structural hardness or strength to resist against the external damaging force or action force. In contrast, in the conventional technique, when the substrate applies a reaction force to the seat body, the surface of the seat body is often worn to lead to loosening of the seat body from the substrate. The present invention overcomes the above problems existing in the conventional technique.

In conclusion, the switch seat body structure and the manufacturing method of the switch seat body structure of the present invention are different from the conventional technique in space form and advantageous over the conventional technique. Therefore, the present invention is greatly advanced and patentable.

The above embodiments are only used to illustrate the present invention, not intended to limit the scope thereof. Many modifications of the above embodiments can be made without departing from the spirit of the present invention.

What is claimed is:

1. A switch seat body structure comprising a main body for assembling with an internal component of a switch, the main body being defined with an axis, the main body being an assembly of a metal head section and a nonmetal belly section, the metal head section having an outer surface and an inner surface, the metal head section having a shoulder section and a skirt section connected with the shoulder section, the shoulder section and the skirt section together defining a shaft hole, the shoulder section protruding radially beyond the skirt section, the skirt section extending toward the nonmetal belly section in the direction of the axis, the nonmetal belly section being connected on at least a part of the skirt section, whereby the nonmetal belly section is connected with the metal head section to form an integral structure;

wherein a part of the skirt section is formed with a recessed section, the nonmetal belly section having an annular recess formed in an outer surface thereof and being connected on the recessed section of the skirt section, the recessed section being formed on the inner surface of the metal head section; a subsidiary shoulder section is formed in the recessed section at a free end of the skirt section, the subsidiary shoulder section protruding radially toward the shaft hole, the subsidiary shoulder section being received in the annular recess of the nonmetal belly section.

2. The switch seat body structure as claimed in claim 1, wherein the recessed section of the skirt section is formed with a rough surface.

3. The switch seat body structure as claimed in claim 1, wherein the nonmetal belly section is a cylindrical body made of plastic material, the surface of the nonmetal belly section being formed with a thread, the nonmetal belly section defining an internal space, in cooperation with the shaft hole of the metal head section, the internal component of the switch being assembled in the internal space of the nonmetal belly section.

4. The switch seat body structure as claimed in claim 3, wherein at least a part of the outer surface of the skirt section in adjacency to the shoulder section is exposed to outer side of the main body.

5. The switch seat body structure as claimed in claim 4, wherein the main body is mounted on a substrate and the outer surface of the skirt section that is exposed to the outer side of the main body is in contact with and assembled with the substrate.

6. The switch seat body structure as claimed in claim 1, wherein at least a part of the outer surface of the skirt section in adjacency to the shoulder section is exposed to outer side of the main body.

7. The switch seat body structure as claimed in claim 6, wherein the main body is mounted on a substrate and the outer surface of the skirt section that is exposed to the outer side of the main body is in contact with and assembled with the substrate.

8. A manufacturing method of the switch seat body structure as claimed in claim 1, comprising steps of:

(a) providing and positioning a metal head section on a female mold of a molding module, a male mold and female mold of the molding module defining therebetween a region in the form of a nonmetal belly section; and (b) filling a nonmetal material into the region defined between the male mold and female mold to form the nonmetal belly section with a thread on the outer surface, the nonmetal belly section being connected on a part of the metal head section, whereby the nonmetal belly section is connected with the part of the metal head section to form an integrated structure.

9. The manufacturing method of the switch seat body structure as claimed in claim 8, wherein the step (b) includes:

filling a nonmetal material into the region defined between the male mold and female mold to form the nonmetal belly section with a thread on the surface, the nonmetal belly section being connected on a part of the inner surface of the metal head section; a subsidiary shoulder section is formed at a free end of the skirt section, the subsidiary shoulder section protruding in a direction toward the axis, the nonmetal belly section is connected with the recessed section of the skirt section and the subsidiary shoulder section of the metal head section to form an integrated structure.

10. The manufacturing method of the switch seat body structure as claimed in claim 8, wherein the step (b) includes:

filling a nonmetal material into the region defined between the male mold and female mold to form the nonmetal belly section with a thread on the outer surface, the nonmetal belly section being connected on a part of the outer surface of the metal head section; a subsidiary shoulder section is formed at a free end of the skirt section, the subsidiary shoulder section protruding in a direction away from the axis, the nonmetal belly section is connected with the recessed section of the skirt section and the subsidiary shoulder section of the metal head section to form an integrated structure.

11. A switch seat body structure comprising a main body for assembling with an internal component of a switch, the main body being defined with an axis, the main body being an assembly of a metal head section and a nonmetal belly section, the metal head section having an outer surface and an inner surface, the metal head section having a shoulder section and a skirt section connected with the shoulder section, the shoulder section and the skirt section together defining a shaft hole, the shoulder section protruding from the metal head section, the skirt section extending toward the nonmetal belly section in the direction of the axis, the nonmetal belly section being connected on at least a part of the skirt section, whereby the nonmetal belly section is connected with the metal head section to form an integral structure, wherein a part of the skirt section is formed with a recessed section, the nonmetal belly section being connected on the recessed section of the skirt section, the recessed section being formed on the outer surface of the metal head section; a subsidiary shoulder section is formed at a free end of the skirt section, the subsidiary shoulder section protruding in a direction away from the axis.

12. The switch seat body structure as claimed in claim 11, wherein the recessed section of the skirt section is formed with a rough surface.

13. The switch seat body structure as claimed in claim 11, wherein the nonmetal belly section is a cylindrical body made of plastic material, the surface of the nonmetal belly section being formed with a thread, the nonmetal belly section defining an internal space, in cooperation with the shaft hole of the metal head section, the internal component of the switch being assembled in the internal space of the nonmetal belly section.

14. The switch seat body structure as claimed in claim 13, wherein at least a part of the outer surface of the skirt section in adjacency to the shoulder section is exposed to outer side of the main body.

15. The switch seat body structure as claimed in claim 14, wherein the main body is mounted on a substrate and the outer surface of the skirt section that is exposed to the outer side of the main body is in contact with and assembled with the substrate.

16. The switch seat body structure as claimed in claim 11, wherein at least a part of the outer surface of the skirt section in adjacency to the shoulder section is exposed to outer side of the main body.

17. The switch seat body structure as claimed in claim 16, wherein the main body is mounted on a substrate and the outer surface of the skirt section that is exposed to the outer side of the main body is in contact with and assembled with the substrate.

* * * * *